US007726704B1

(12) United States Patent
Goldstein et al.

(10) Patent No.: US 7,726,704 B1
(45) Date of Patent: Jun. 1, 2010

(54) APPARATUS AND METHOD FOR COVERING AN OPENING

(76) Inventors: Steven Martin Goldstein, P.O. Box 533, Herald, CA (US) 95638; Robert Wayne Vanzee, 37462 Glenmore Dr., Fremont, CA (US) 94536

( * ) Notice: Subject to any disclaimer, the term of this patent is extended or adjusted under 35 U.S.C. 154(b) by 141 days.

(21) Appl. No.: 11/900,297

(22) Filed: Sep. 10, 2007

Related U.S. Application Data

(63) Continuation-in-part of application No. 11/185,922, filed on Jul. 20, 2005, now abandoned.

(60) Provisional application No. 60/590,409, filed on Jul. 21, 2004.

(51) Int. Cl.
*E05C 19/00* (2006.01)

(52) U.S. Cl. ..... 292/1; 292/256.67; 292/256.73; 411/340; 411/344

(58) Field of Classification Search ..... 292/256.57, 292/1, 256, 73, 258, 288, 301, 348, 350, 292/DIG. 11, 341.14, 251; 220/200; 411/340, 411/344, 388–389; 174/543; 403/10, 408.1
See application file for complete search history.

(56) References Cited

U.S. PATENT DOCUMENTS

| | | | | |
|---|---|---|---|---|
| 2,422,420 | A * | 6/1947 | Judd | 220/251 |
| 4,650,229 | A * | 3/1987 | Bardfeld | 292/167 |
| 4,902,180 | A * | 2/1990 | Gauron | 411/82.1 |
| 4,914,258 | A * | 4/1990 | Jackson | 174/45 R |
| 6,039,408 | A * | 3/2000 | Alvarez | 301/35.623 |
| 6,064,005 | A * | 5/2000 | Raasch | 174/66 |
| 6,698,260 | B2 * | 3/2004 | Su | 70/134 |

* cited by examiner

*Primary Examiner*—Carlos Lugo
*Assistant Examiner*—Mark Williams
(74) *Attorney, Agent, or Firm*—Robert S. Smith

(57) ABSTRACT

A cover and method for covering openings an particularly openings initially intended to cover door knob openings and lock set openings of a modified door which are required to be covered for aesthetic and security reasons. In one embodiment, the cover for a door knob hole is an integral stack of disks wherein the largest outermost disk covers the opening when centered by the second disk that fits snugly inside the opening. A bridge fits inside the lock-set cavity to which a cover over the lock cavity is bolted.

6 Claims, 7 Drawing Sheets

APPARATUS AND METHOD FOR COVERING AN OPENING

CROSS REFERENCE TO RELATED APPLICATIONS

This application is a Continuation-In Part of application Ser. No. 11/185,922 filed Jul. 20, 2005, now abandoned claiming priority from provisional application 60/590,409 filed Jul. 21, 2004 titled "APPARATUS AND METHOD FOR COVERING OPENINGS.

FIELD OF THE INVENTION

The present invention relates to devices used to covering openings in doors.

BACKGROUND AND INFORMATION DISCLOSURE

Doors and such often have openings provided for locking devices. Such holes left uncovered generally look unfinished. Other locking devices are removed for legal reasons and safety leaving the door unsecured. In some cases a panic exit is installed that allow the door to be secured from outside But openable from the inside. Many times such devices interfere with panic exit devices and other devices associated with the security of the door . . . . Currently devices are used to cover opening s in doors allowing them to be secured from the outside but they often interfere with the operation of the panic devices. Present art apparatus are unsatisfactory because they are through bolted from one side of the hollow object to the other. Currently, through hole fillers cannot be used because the screw/post connecting the inside disk to the outside disk will interfere with the concealed vertical rods inside the door. Thus for appearance and security, one or more holes need to be drilled without interfering internal parts of the door or objects.

U.S. Pat. No. 2,422,420 to Judd discloses a cover for a hole in a panel wherein the slotted head of a screw is visible and accessible from the exposed side of the panel. The device I intended to cover a hole in the fuselage of an airplane so that centering the cover over the hole is not a strict requirement. The Judd device does not satisfy the requirements that are satisfied by the present invention. FIGS. 4A,B and 5 are typical examples of holes for door knobs, lock cylinders etc. that are exposed at the edge of a door 400 that is to be modified when holt 402 and cavity 404 are no longer needed.

Lock cavity 404 is bounded by two walls (being opposing door panels of the door) and two interior end surfaces. Doorknob holes 402 were initially used to mount a doorknob.

In many construction upgrade operations involving modification of a door, preferably, holes 402 and 404 would be covered for beautification and security purposes. It would be desirable for beautification purpose that neither screw heads (i.e., the slotted heads of screws) nor the head of Phillip head screws) be visible from the viewable side of the door.

Therefore, what is needed is a method and apparatus to cover these holes in doors and other items. Further, what is needed is an apparatus and method to quickly and effectively cover existing cylinder, lock face and other unwanted holes/openings in any object made of any material which would benefit in terms of beautification, a more universally usable and versatile in operation than known apparatus of this kind.

SUMMARY OF THE INVENTION

An aspect of the present invention is an apparatus for covering so as to shield from view and opening such as a door hole in a door panel of a door of material. E.g., wood, metal, plastic.

The apparatus includes a three-stepped disk shaped outer member. A first step is a disk sized to cover the opening.

A second disk is formed concentric with and adjacent against the first disk. The second disk is configured to fit in the opening in the panel to be covered.

The third step is a disk concentrically formed on the second disk. The third disk is sized to fit in an inner opening of the material such as are found Sometimes in an opening profile for a lock, for example. The third disk has a concentric threaded bore.

The apparatus further includes an inner securing plate wherein a side surface of the plate has a dimension than the wall opening to be covered. An aperture is formed through the side of the securing member.

The apparatus is sized to accept the bolt, which is screwed into the bore of the third step. The aperture is sized smaller than a head of the bolt so that the wall of the cavity may be captured between the inner securing member and the first step. And secured by tightening the bolt to draw the inner securing member and the first step of the outer member together to clamp on the cavity wall to cover and seal the opening.

BRIEF DESCRIPTION OF THE DRAWINGS

So that the manner in which the above features and objets of the present invention are attained and can be understood in detail, the following drawings are presented.

DESCRIPTION OF PREFERRED EMBODIMENTS

Figure 1A:
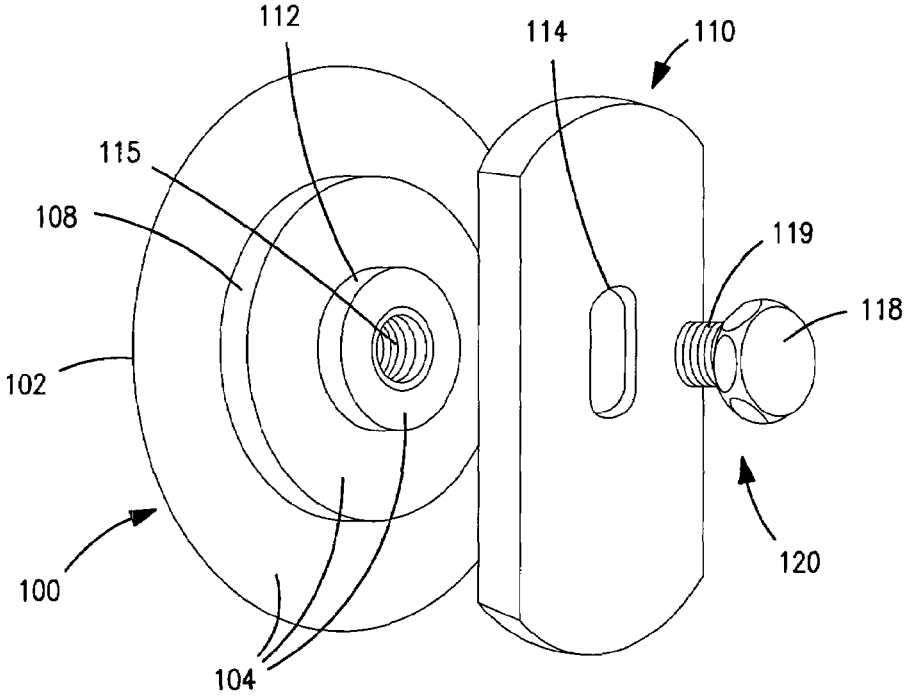
FIG. 1A is an exploded perspective view of the disk cover.
Figure 4A:
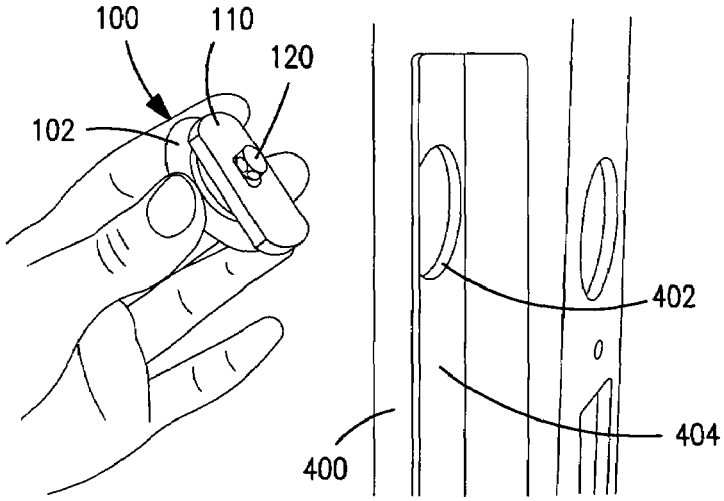
FIGS. 4A,B shows steps of the method for securing a disk hole cover over a hole.
Figure 5:
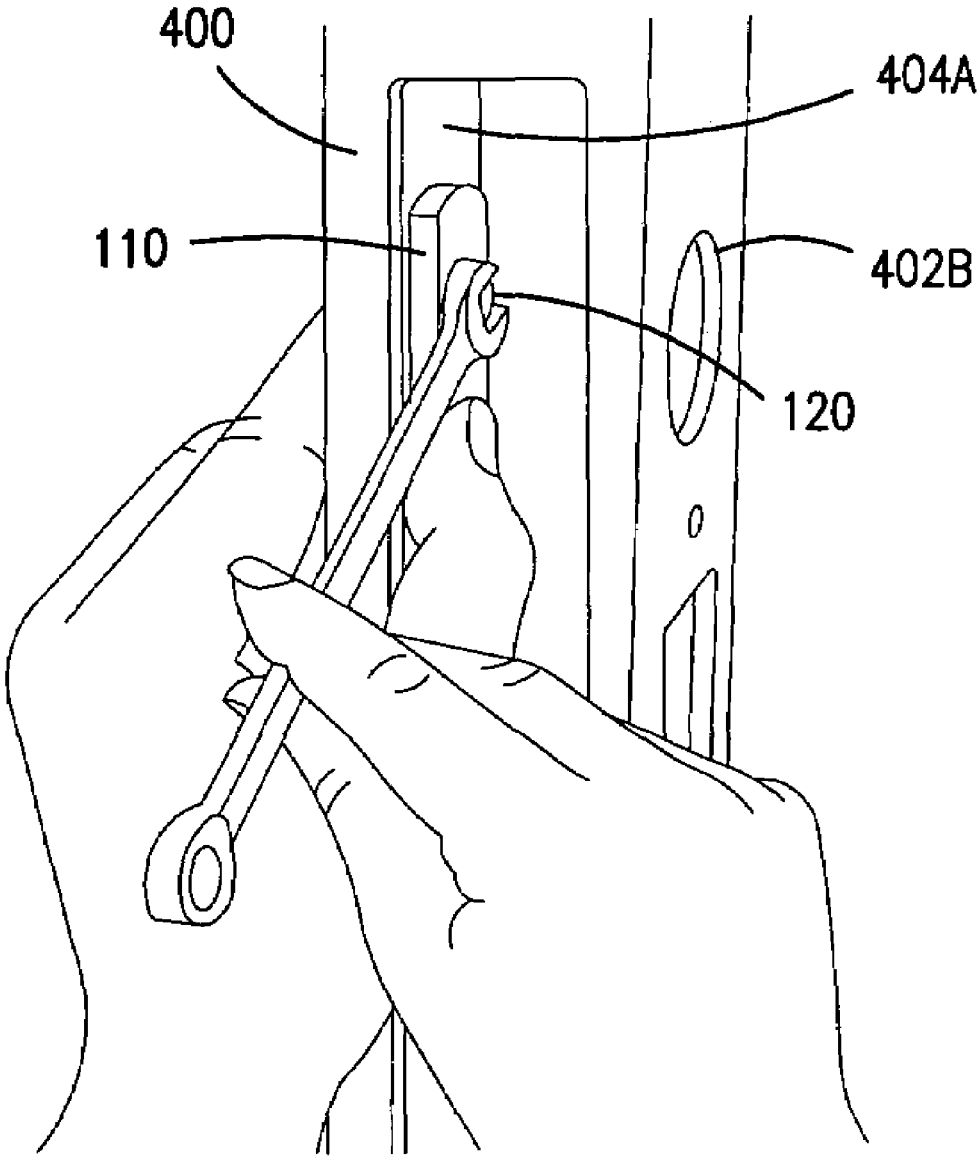
FIG. 5 shows the final step in securing the disk hole cover over a hole.

Turning to a description of the drawings, FIG. 1A is an exploded perspective view of a disk hole cover 100 of this invention configured to cover a door knob opening 402 communicating with a lock cavity 400 as shown in FIGS. 4A,B and FIG. 5.

Doors with such holes are made of aluminum, wood, metal, glass, composite material and the like.

FIG. 1A shows one configuration in which the disk hole cover 100 has a three-step structure of three stacked disks, arranged concentrically. There are shown a (largest outer disk 102, a smaller (intermediate) disk 108 and the smallest (end) disk 112.

The second (intermediate) disk 108 is sized to fit snugly into the door knob opening 402 thereby centering the disk stack (disk hole cover 100) over the for knob opening 402.

A blind threaded hole 115 passes entirely through the center of the end disk 112 and second disk 108 and partly through outer disk 102.

A closure member 110 is a plate that is positionable inside lock cavity against the inside surface of cavity wall 404A where it spans across the doorknob opening 402.

A bolt being a threaded stem with a bolt head, is sized for insertion through an aperture 114 centrally located in closure member 110 and screwing one end of the threaded stem into hole 115 of disk steps 108 and 112. The cavity wall is thereby captured between closure member 110 and disk hole cover 100 and secured by tightening bolt 120. The closure member 110 and bolt head formed on another end of the threaded stem is therefore a means for securing another end of said threaded stem in said bolt hole.

Figure 1B:
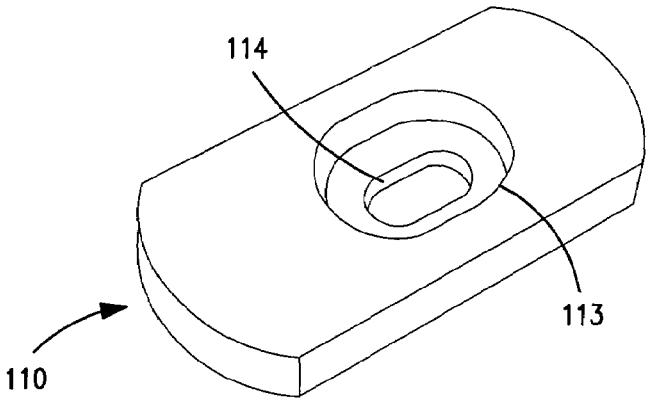
FIG. 1B show a securing member for the disk hole cover of FIG. 1A.

Closure member 110 may be formed generally rectangular in shape (as illustrated in FIGS. 1A and 1B).

FIG. 1B is a bottom perspective view of closure member 110 of FIG. 1A. Closure member 110 has cavity 113 sized to accept element 112.

Once the disk hole cover 100 is positioned over the exterior of the door 400 so as to cover a door knob opening and then attached to the closure member 110 with bolt 120, the door knob opening 402 will no longer be exposed or accessible from outside the door 400, thereby beautifying, covering and securing the door.

Figure 2:
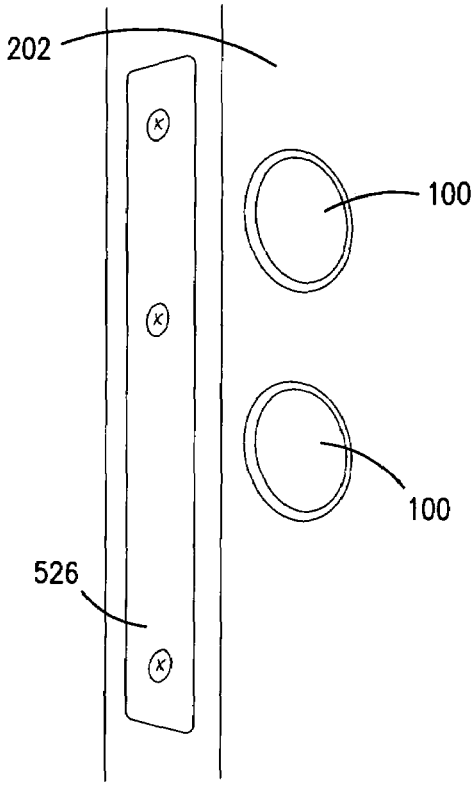
FIG. 2 shows two disk hole covers covering openings in the door.

FIG. 2 is a perspective view of one embodiment of two or more disk hole covers 100 configured to cover door hole openings in accordance with embodiments of the invention.

Figure 3:
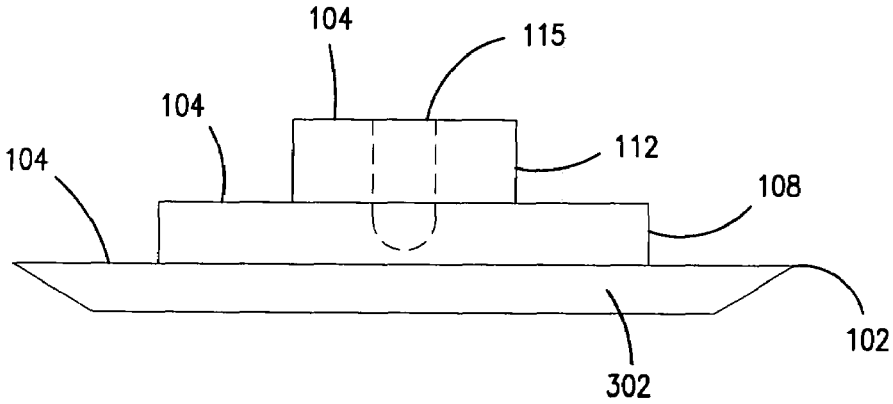
FIG. 3 is an elevation view of the disk hole cover of FIG. 1.

FIG. 3 is front elevation view of disk hole cover 100 configure to cover openings in accordance with embodiments of the invention. In one embodiment, the edge 302 of door hole cover 402 is tapered to merge with an outer surface of a door 400.

FIG. 4A is a perspective view of a first step of installation of disk hole cover 100 to cover a door knob opening 402 according to the invention. As shown in FIG. 4A in the initial step, the disk hole cover 100 is poised for partial insertion through door knob opening 402 such that the outer disk 102 (first step) of disk hole cover 100 remains outside cavity 404.

Figure 4B:
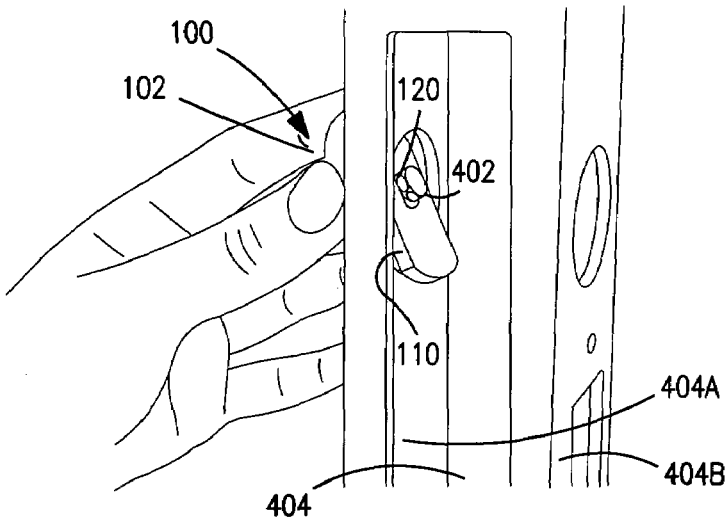

FIG. 4B is a perspective view illustrating a second step of installation to cover door knob opening 402. The disk hole cover 100 is inserted partially Through door knob hole 402 so that the outer disk 102 (the first step) of the disk hole cover 100 remains outside the cavity 404 with closure member 110 hooked interiorly onto the wall 404A of cavity 404.

FIG. 5 is a perspective view illustrating a final step of installing disk hole cover 100 on a door 400 to cover the door knob hole 402.

The wall 404A of lock cavity 404 is captured between closure member 110 and the first disk step 102 of disk cover 100 and secured by the bolt 120. The shank of bolt 120 passes through the closure member 110 and screwed into disk hole cover 100.

In operation the outer disk member 02 is sized with a diameter larger than the door knob opening 402 in the wall 303A of the lock cavity 404 and when clamped on door 400 of the wall 404A, the closure member 110 and outer disk member 102 cover and secure door knob opening 402 A opposite door knob opening 402B is concealed in FIG. 5.

Figure 6:
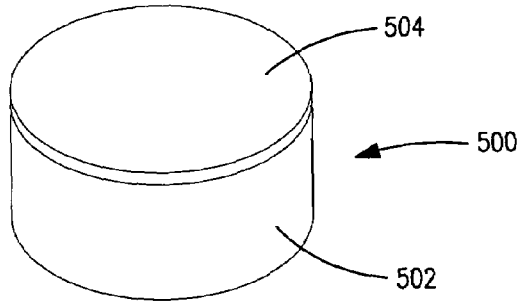
FIG. 6 shows a rubber disk with an adhesive surface for use as a wrench.

FIG. 6 is an alternative to the step illustrated in FIG. 5. showing the final step of applying a wrench from outside the step cavity to turn bolt 120/

FIG. 6 shows a "wrench" comprising rubber disk 502 typically ½ inch thick and having a diameter equal to the diameter of outer disk 102. A flat surface 504 of the rubber disk is coated with adhesive.

To screw the disk hole cover 100 onto bolt 120 positioned inside the lock cavity 400. as shown in FIG. 5, the adhesive side 504 of the rubber disk 500 is pressed against the outside surface of disk hole cover 100 and rotated.

To prevent bolt 120 from turning while screwing into threaded hole 115, the user's finger is inserted inside the cavity hole and pressed against the head of bolt 120. After bolt 120 and disk member 102 are screwed together, the user peels rubber disk 500 off disk hole cover 100.

Figure 9:
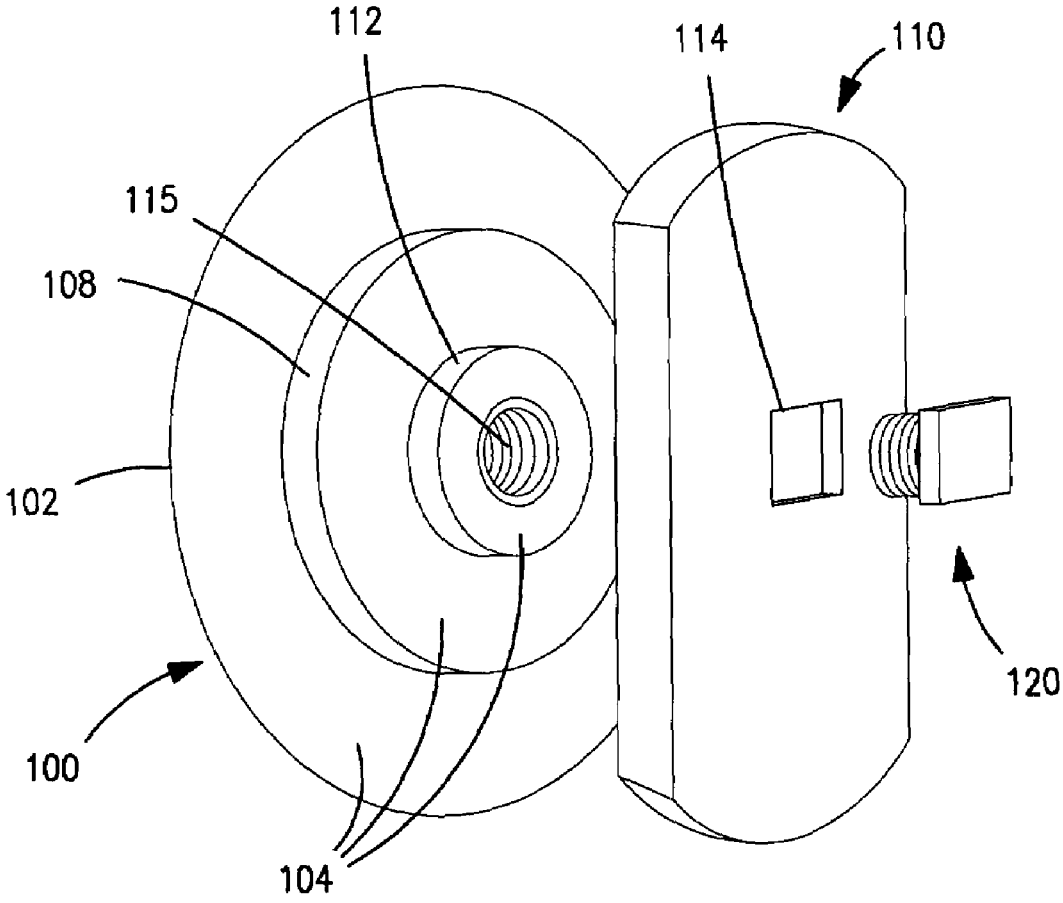
FIG. 9 shows a square bolthole head and square opening in the closure member.

FIG. 9 shows an alternative to prevent bolt 120 turning in which cavity 113 in closure member 110 is square to accept the head of bolt 120.

The adhesive surface 504 of the rubber disk 502 is covered by a paper-thin material as well known in the art of adhesives when the "rubber wrench" is not in use.

Figure 7:
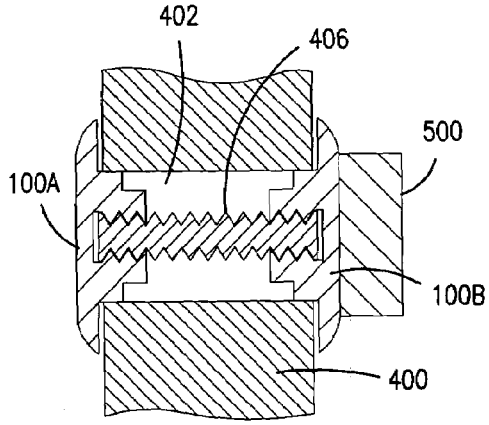
FIG. 7 shows the wrench of FIG. 6 attached to a disk device.

FIG. 7 shows another embodiment for the situation where a doorknob opening 402 extends all of the way through the door 400.

For this situation, a threaded stem 406 has one end screwed into one disk hole cover 100 and is inserted entirely through the door knob opening with the one disk hole openings.

A second disk hole cover 1000 having its exposed surface attached to the rubber wrench of this invention is screwed onto the extended end of the threaded stem 406 so as to draw the two disk cover together and cover both door knob holes. The second disk cover 110B, having its exposed surface attached to the rubber wrench of this invention, and screwed onto the extended of the threaded stem, is therefore "a means for securing another end of said threaded stem in said bolt hole".

The adhesive surface 504 of the rubber disk 502 is covered by a paper-thin material as well known in the art of adhesives when the "rubber wrench" is not in use.

FIG. 7 shows another embodiment for the situation where a doorknob opening 402 extends all of the way through the door 400.

For this situation, a threaded stem 406 has one end screwed into one disk hole cover 100 and is inserted entirely through the door knob opening with the one disk hole openings.

A second disk hole cover 1000 having its exposed surface attached to the rubber wrench of this invention is screwed onto the extended end of the threaded stem 406 so as to draw the two disk cover together and cover both door knob holes.

Figure 8:
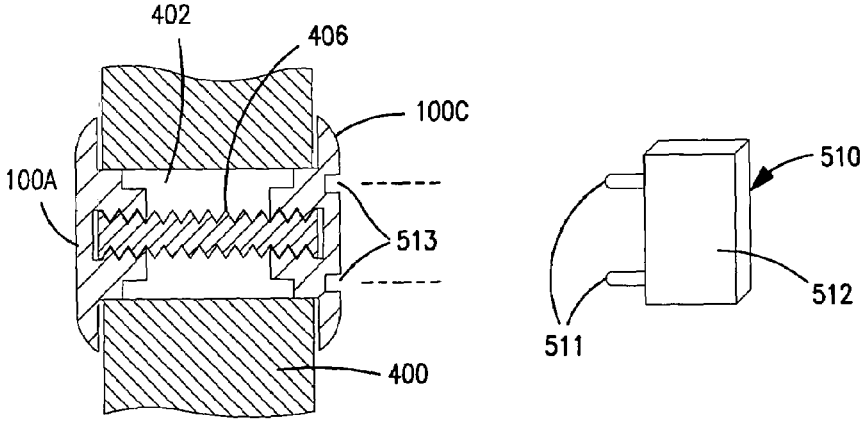
FIG. 8 shows an alternative method for screwing two disk covers together.

FIG. 8 shows (in place of "rubber wrench" of FIG. 7) a wrench 510 of this, invention which is used to secure two disk hole covers 100A and 100C inserted in opposite ends of door knob through opening 402 extending between opposite sides of door 400.

Wrench 510 comprises a pair of studs 511 extending from a handle section 512. In use the studs 511 are inserted into two small holes 51113 in the exposed surface of one of the disk hole covers 100 and the disk hole cover 100C is rotated in order to screw the threaded stem into both disk hole covers 100 A,C.

FIGS. 4A 4B and 5 show a common situation where a lock cavity 404 is positioned between the opposing door openings, 400 A, B.

After the disk hole covers 100 of this invention are installed (as described above)

There remains a lock cavity 404 as shown in FIG. 4.

FIG. 4 shows an edge surface of a door 400 with an exposed lock cavity 404. FIG. 2 shows a desired completed job including an attractive cover panel 526 that completely covers the lock cavity 402 and is continuos (coplanar) with the outside surface of the edge of the door.

In practice cover panel formed a part of the lock mechanism that was initially inserted into the lock cavity. However the lock mechanism has been removed according to the later reconstruction plan.

Figure 10A:
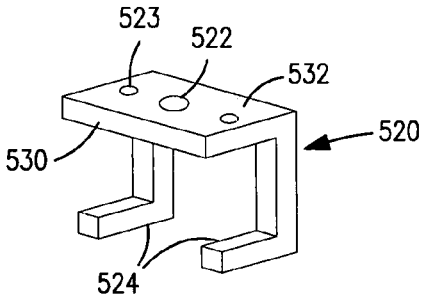
FIGS. 10 A, B, C, D show a bridge for supporting a lock cavity cover.
Figure 10C:
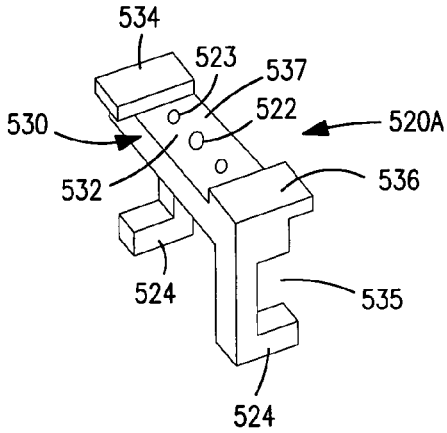
Figure 10B:
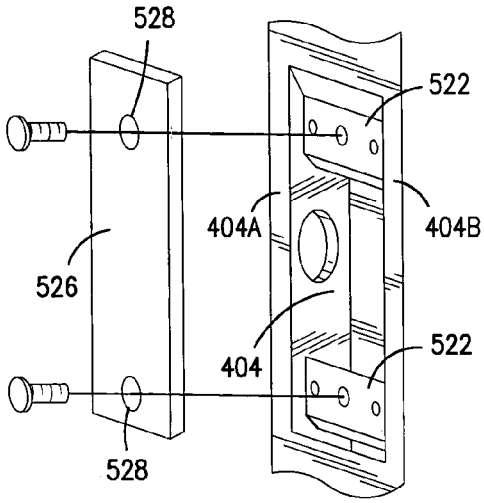
Figure 10D:
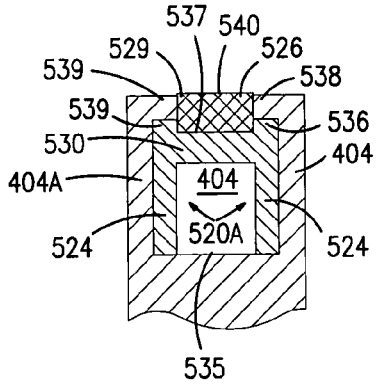

FIGS. 10A, B, C show a feature of the invention being a bridge 520, a pair of which, positioned between cavity walls 404A,B support a cover panel 526. that conceals lock cavity 404 as shown in FIG. 10B.

Bridge 520 comprises a pair of legs 524 supporting a bridge panel 522. Bridge 520 is bolted the cavity floor through screw holes 523 in support of panel 522.

by a connecting surface 537 of the channel 530. Channel shoulder 534 is separated from channel shoulder 536 by a distance equal to the width of the lock cavity cover 526.

As shown by the sectional view 10D, Channel 530 has a depth such that when the bridge 520A is positioned in the lock cavity 404, with bridge feet 524 supported on a bottoming surface 535 of the lock cavity. Each channel shoulder 539 is positioned against a cavity shoulder 538 of lock cavity 404 and the lock cavity cover 526 is supported on the connecting surface 537 with an exposed surface 540 of the lock cavity cover coplanar with an exposed surface 529 of the edge of the door and with the legs 524 extending between the bridge panel 535 and the bottom surface of the lock cavity 404.

It will be understood that, in the context of this specification, cavity holes and door knob hole are representative of several situations that are encountered in practice. Thus one example where the "spirit and interpretation" of this invention apply is to the well known wooden door common to residences.

with the free end of each leg 424 supported against a bottom surface of the lock cavity 404. A cover panel 526 is laid against the lock cavity 404.

A cover panel 526 is laid against the lock cavity lid 404. Each end of the cover panel is supported by a bridge panel 522. A respective one of the bridges 520 A screw is inserted through a respective hole 5268 in the cover plate and screwed into the bridge. The exposed surface of the cover plate is flush with the surface of the door 400 giving a "finished" appearance to what was formerly an open cavity.

FIG. 10C illustrates an embodiment of the bridge when width of the opening to the lock cavity 404 is smaller than a separation of the walls 404A and 404B of the lock cavity whereby an internal shoulder 537 along the edge of the lock cavity is formed.

The lock hole cover 526 has a width equal to the separation between the internal shoulders 527.

A channel 530 is formed in the support surface 532 of the bridge 520A with one channel shoulder 534 and opposite channel shoulder 536 separated Similarly, such openings to be covered are found in commercial buildings where doors are typically glass framed in square metal tubes referred to as "styles" in the trade.

In another situation to which the teachings of using a disk hole cover of this invention apply, is where the round hole is a keyed lock cylinder of thumbturn device used to lock/unlock a mortise lock.

Variations and modifications to meet these contingencies may be contemplated after reading the specification and studying the drawings which are within the scope of the invention. We therefore wish to define the scope of the invention by the appended claims.

The invention claimed is:

1. A device for covering from view and preventing access from an exterior side of a door to a door knob hole (402) in said door, when said door is closed, said door knob hole opening into a lock cavity in an edge surface of said door and said lock cavity bounded by one wall and an opposite wall, said one wall and said opposite wall having a wall thickness, both walls being a part of a door panel opposite another door panel of said door, said device comprising:

a disk hole cover (100) including an outer disk (102) integrally formed on a second disk (108);

said outer disk larger and concentric with said second disk (108);

said second disk configured to fit snuggly into said door knob hole;

a threaded bore concentric with and extending through said second disk and partly into said outer disk;

a threaded stem having one end screwed into said threaded bore;

means for securing another end of said threaded stem in said door knob hole providing that said disk hole cover is retained with said outer disk flush against said exterior side of said door and said second disk is positioned snuggly in said door knob hole;

and providing that accessing said door knob hole from said exterior side of said door is prevented;

a lock cavity panel having the length and width of an opening to said lock cavity;

at least one bridge including a bridge panel and a pair of legs;

said bridge panel having a support surface bounded by one straight edge parallel to an opposite straight edge;

each said leg having one end attached to said one straight edge and extending perpendicularly away from said respective bridge panel in the same direction as said other leg of said pair;

each leg having a foot on a free end of said each respective leg;

each leg having a length to permit that, when said pair of legs are positioned in said lock cavity with said foot of each leg supported on a bottom surface of said lock cavity opposite said opening of said lock cavity and with said support surface of said bridge panel parallel to and facing away from said bottom surface of said lock cavity, an exposed surface of said lock cavity panel positioned on said support surface is coplanar with said surface of said edge of said door;

means for securing said lock cavity cover on said support surface of each said bridge.

2. The device of claim 1 wherein said door knob hole extends entirely through said door and said means for securing comprises:

another disk hole cover (100) including another outer disk (102) integrally formed on another second disk (108);

said another outer disk larger than and concentric with said another second disk (108);

said another second disk configured to fit snugly into said door knob hole;

another threaded bore concentric with and extending through said another second disk and partway into said another outer disk of said disk hole cover;

said another end of said threaded stem screwed onto said another threaded bore;

a detachable wrench means attached to an outer surface of said another disk hole cover with which said another disk is screwed onto said another end of said threaded stem providing that said door is clamped between said disk hole cover attached by said threaded stem to said another disk hole cover and said another disk hole cover.

3. The device of claim 2 wherein said detachable wrench means comprises:

a rubber disk having a flat adhesive surface detachably attached to an outside surface of said another disk hole cover providing that, after said disk hole cover and another disk hole cover with attached rubber disk are connected with said threaded stem through said door hole, said disk hole cover and second disk hole cover are secured by turning said rubber disk to tighten said disk hole covers together, said rubber disk is peelable from said another disk hole cover.

4. The device of claim 2 wherein said detachable wrench means comprises:

a handle;

a pair of studs extending from said handle parallel to one another;

said another disk hole cover having, in an outside surface of said outer disk, a pair of holes dimensioned and spaced from one another to permit engaging said pair of studs in said pair of holes to enable tightening said threaded stem in said first and second disk hole cover then withdrawing said wrench from said second disk hole cover.

5. The device of claim 1 wherein said door knob hole opens into a lock cavity in an edge surface of a door, said lock cavity bounded by one wall and an opposite wall, both walls being part of a door panel opposite another door panel of said door, said device further comprising:

a third disk formed integrally and concentrically onto said second disk;

said third disk having a diameter smaller than said second disk;

said second disk having a thickness less than a thickness of said wall;

said threaded bore extending through said third disk; and said means for securing another end of said threaded stem includes a closure panel (110) having two flat parallel surfaces wherein a largest dimension of said parallel surfaces is larger than a diameter of said door knob hole:

said closure panel having a panel cavity in a surface of said closure panel and dimensioned to provide that said third disk fits snugly in said panel cavity;

said closure panel having a central bore located and dimensioned to permit passing said extended end of said threaded stem through said central bore cavity and said central bore;

a bolt head on said extended end dimensioned larger than said bore in said closure panel providing that said outside disk and closure panel are forced toward one another by turning said bolt head whereby said cavity wall is clamped between said closure panel and said outside disk and providing that viewing and accessing said door knob and said fastener from an exterior side of said door when said door is closed is prevented.

6. A device for covering from view and preventing access from an exterior side of a door to a door knob hole (402) in said door, when said door is closed, said door knob hole opening into a lock cavity in an edge surface of said door and said lock cavity bounded by one wall and an opposite wall, said one wall and said opposite wall having a wall thickness, both walls being a part of a door panel opposite another door panel of said door, both walls having an internal shoulder along longest edges of said lock cavity, said device comprising:

a disk hole cover (100) including an outer disk (102) integrally formed on a second disk (108);

said outer disk larger and concentric with said second disk (108);

said second disk configured to fit snuggly into said door knob hole;

a threaded bore concentric with and extending through said second disk and partly into said outer disk;

a threaded stem having one end screwed into said threaded bore;

means for securing another end of said threaded stem in said door knob hole providing that said disk hole cover is retained with said outer disk flush against said exterior side of said door and said second disk is positioned snuggly in said door knob hole;

and providing that accessing said door knob hole from said exterior side of said door is prevented;

a lock cavity panel having the length of an opening to said lock cavity and a width selected to permit support of said lock cavity panel on said shoulders;

at least one bridge including a bridge panel and a pair of legs;

said bridge panel having a support surface bounded by one straight edge parallel to an opposite straight edge;

each said leg having one end attached to said support surface and extending perpendicularly away from said respective bridge panel in the same direction as said other leg of said pair;

each leg having a foot on a free end of said each respective leg;

each leg having a length to permit that, when said pair of legs are positioned in said lock cavity with said foot of each leg supported on a bottom surface of said lock cavity opposite said opening of said lock cavity *—and with said support surface of said bridge panel parallel to and facing away from said bottom surface of said lock cavity, an exposed surface of said lock cavity panel positioned on said support surface is coplanar with said edge surface of said edge of said door;

means for securing said lock cavity cover on said support surface of each said bridge.

* * * * *